US005737906A

United States Patent [19]

Ishimaru

[11] Patent Number: 5,737,906

[45] Date of Patent: Apr. 14, 1998

[54] QUICK PRESSURE REDUCING APPARATUS

[75] Inventor: Hajime Ishimaru, Tsukuba, Japan

[73] Assignee: Zaidan Houjin Shinku Kagaku, Japan

[21] Appl. No.: 697,216

[22] Filed: Aug. 21, 1996

[30] Foreign Application Priority Data

Feb. 1, 1996 [JP] Japan ..... 8-038753

[51] Int. Cl.[6] ..... B65B 31/00

[52] U.S. Cl. ..... 53/512

[58] Field of Search ..... 53/510, 512, 432, 53/434, 370.7, 371.8, 386.1

[56] References Cited

U.S. PATENT DOCUMENTS

| | | | |
|---|---|---|---|
| 3,312,256 | 4/1967 | Reisinger | 53/512 |
| 3,511,020 | 5/1970 | Kraft et al. | 53/512 |
| 3,945,171 | 3/1976 | Marietta, Jr. et al. | 53/512 |
| 4,185,441 | 1/1980 | Hoyt | 53/512 |
| 4,241,558 | 12/1980 | Gidewall et al. | 53/512 |
| 4,541,224 | 9/1985 | Mugnai | 53/512 |
| 4,860,523 | 8/1989 | Teteishi et al. | 53/512 |
| 5,140,801 | 8/1992 | Wild | 53/386.1 |
| 5,263,520 | 11/1993 | Arai | 53/512 |
| 5,491,957 | 2/1996 | Maskell | 53/432 |
| 5,551,213 | 9/1996 | Koelsch et al. | 53/512 |

FOREIGN PATENT DOCUMENTS

| | | | |
|---|---|---|---|
| 0046592 | 3/1982 | European Pat. Off. | 53/512 |
| 0023785 | 3/1978 | Japan | 53/512 |

*Primary Examiner*—Lowell A. Larson
*Assistant Examiner*—Ed Tolan
*Attorney, Agent, or Firm*—Adams & Wilks

[57] ABSTRACT

A quick pressure reducing apparatus is used in vacuum packing of clothing, food, or the like. In order to quickly shift the interior of a preservation bag from the atmospheric state to a pressure reduced state, a reservoir tank is provided which is connected to a rotary pump functioning as a vacuum pump. By establishing communication between the reservoir tank and the preservation bag via an adapter, the internal pressure of the preservation bag can be sufficiently reduced. The adapter has a retractable communicating tubular member so as to smoothly reduce the internal pressure of the preservation bag. The adapter is inserted into the opening portion of the preservation bag whose internal pressure is to be reduced, thereby establishing communication between the preservation bag and the reservoir tank via the communicating tubular member. The opening portion of the preservation bag, together with the inserted adapter, is held between the upper and lower holding members. The communicating tubular member, which has a number of small holes formed at its forward end portion, is projected from the adapter into the preservation bag by a drive mechanism. Accordingly, the internal pressure of the preservation bag can be quickly reduced while preventing the opening edge portion of the preservation bag or the like from closing the communicating tubular member.

23 Claims, 3 Drawing Sheets

QUICK PRESSURE REDUCING APPARATUS

BACKGROUND OF THE INVENTION

1. Field of the Invention

The present invention relates to a quick pressure reducing apparatus used for preserving clothing, food, articles made of leather, optical devices, electronic materials such as semiconductor devices, paintings, and the like.

2. Description of the Related Art

Generally, when clothing, food, or the like is to be vacuum packed in a preservation bag made of plastic film such as polyethylene, the preservation bag containing the article is placed in a container having a cover for hermetically sealing the container, and then the container is connected to a rotary pump to reduce pressure to about 0.1 atmosphere. Since the preservation bag is left open, the inside of the same is also pressure reduced. Then, the opening portion of the preservation bag is heat sealed. As a result, the article such as clothing or food is sealed in the preservation bag under a reduced pressure. Then, air is led into the container, and the cover is opened to remove the preservation bag from inside the container.

According to the above-mentioned conventional pressure reducing means, since a container having a cover for hermetically sealing the container and containing a preservation bag is pressure-reduced, the volume to be pressure reduced is relatively large, resulting in a relatively long time required for reducing the pressure. In addition, a heat seal device must be provided inside the container in order to seal the preservation bag, requiring the container to have a larger volume.

To cope with these problems, an apparatus has been developed in which an adapter is inserted into the opening portion of a preservation bag so as to evacuate the bag through a communicating bore formed in the adapter. However, use of such an adapter having only a communicating bore involves a problem that a quick pressure reducing operation causes the flexible wall of a preservation bag to block the communicating bore, resulting in an insufficient pressure reduction.

SUMMARY OF THE INVENTION

An object of the present invention is to provide a quick pressure reducing apparatus whose adapter has a movable communicating tubular member which is inserted into the opening portion of a preservation bag so as to smoothly reduce the internal pressure of the preservation bag and which allows efficient charge of an inert gas into the preservation bag after the pressure reduction.

In order to achieve the above-mentioned object, the quick pressure reducing apparatus of the present invention has an adapter to be inserted into the opening portion of a preservation bag, a pair of upper and lower holding members, each having a seal pad, for holding the opening portion of the preservation bag after insertion of the adapter into the opening portion, a first drive mechanism for adjusting the spacing between these holding members, a reservoir tank connected via a first valve to a movable communicating tubular member provided in the adapter for reducing the internal pressure of the preservation bag, and a rotary pump connected via a second valve to the reservoir tank. The quick pressure reducing apparatus further comprises a movable heat seal device capable of heating and thereby sealing the opening portion of the preservation bag. A number of small holes are formed in the circumferential wall of a front end portion of the communicating tubular member, and a second drive mechanism is further provided for projecting the front end portion of the communicating tubular member from inside the adapter into the preservation bag.

In the quick pressure reducing apparatus of the present invention, the rotary pump may be connected to the communicating tubular member via a third valve.

In the quick pressure reducing apparatus of the present invention, an inert gas source may be connected to the communicating tubular member via a fourth valve so as to lead an inert gas into the preservation bag through the communicating tubular member after the internal pressure of the preservation bag has been reduced.

In the quick pressure reducing apparatus of the present invention, the first and fourth valves may be integrated into a single changeover valve.

In the quick pressure reducing apparatus of the present invention, suction holes may be formed in a contact surface of each holding member, which contact surface contacts the circumferential wall of the opening portion of the preservation bag, and the reservoir tank may be connected to the suction holes via a fifth valve.

The quick pressure reducing apparatus of the present invention functions as follows. First, the reservoir tank is evacuated by the rotary pump.

Next, the adapter is inserted into the opening portion of the preservation bag, and the opening portion, which has received the inserted adapter, is tightly held by the upper and lower corresponding holding members.

Then, the communicating tubular member of the adapter is projected into the preservation bag, and communication between the communicating tubular member and the reservoir tank is established so as to reduce the internal pressure of the preservation bag. Since a number of small holes are formed in the circumferential wall of the front end portion of the communicating tubular member, the communicating tubular member maintains in any case its communicating function which otherwise would be lost due to the preservation bag contents, such as clothing, being sucked onto the communicating tubular member. The first valve is opened for only about one or two seconds, during which the rotary pump communicates with the reservoir tank via the second valve, and the rotary pump operates under a relatively small load. After the first valve is closed, if needed, the second valve is closed and the third valve is opened so that the rotary pump directly evacuates, through the communicating tubular member, the interior of the preservation bag. If needed, an inert gas (nitrogen gas, etc.) is led through the communicating tubular member into the preservation bag having a reduced pressure by opening the fourth valve or by switching the changeover valve. While the inert gas is being fed, the rotary pump is operated to increase the degree of vacuum of the reservoir tank.

As has been described above, the quick pressure reducing apparatus of the present invention provides the following effects or advantages:

(1) The adapter to be inserted into the opening portion of a preservation bag is provided with the retractable communicating tubular member, and a number of small holes are formed in the circumferential wall of the front end portion of the communicating tubular member. Thus, while the preservation bag is being evacuated through the communicating tubular member, blocking of the communicating tubular member does not occur. This blocking would otherwise occur due to the opening edge portion of the preservation bag or the preservation bag contents, such as clothing, being sucked onto the communicating tubular member. Accordingly, the internal pressure of the preservation bag is quickly and securely reduced.

(2) The opening portion of the preservation bag with the inserted adapter is held by the upper and lower holding members, each having a seal pad. Thus, the preservation bag continuously and securely communicates with the reservoir tank or the inert gas source via the communicating tubular member of the adapter.

(3) Suction holes are formed in the contact surface of each holding member, which contacts the circumferential wall of the opening portion of the preservation bag. Thus, when the suction holes are rendered in communication with the reservoir tank, the circumferential wall of the opening portion of the preservation bag is vacuum attached to each of the holding members, thereby efficiently opening the preservation bag and facilitating insertion of the adapter into the opening portion.

(4) An inert gas can be directly led into the preservation bag through the communicating tubular member of the adapter. Therefore, the inert gas is not wasted.

(5) Since the rotary pump can be maintained in continuous operation, overall work efficiency improves.

(6) The introduction of an inert gas into the preservation bag after pressure reduction can be performed efficiently through the operation of the changeover valve.

DETAILED DESCRIPTION OF THE PREFERRED EMBODIMENT

Figure 1:
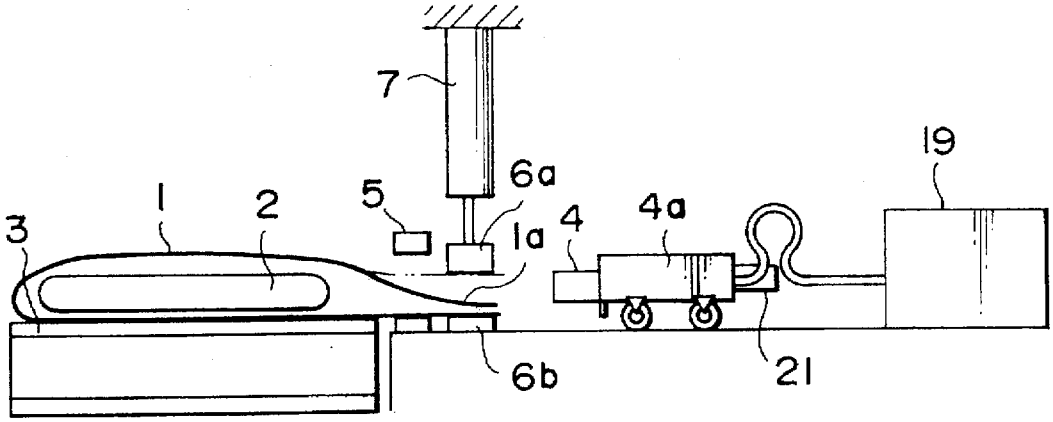
FIG. 1 is a schematic diagram of a quick pressure reducing apparatus according to an embodiment of the present invention.
Figure 2:
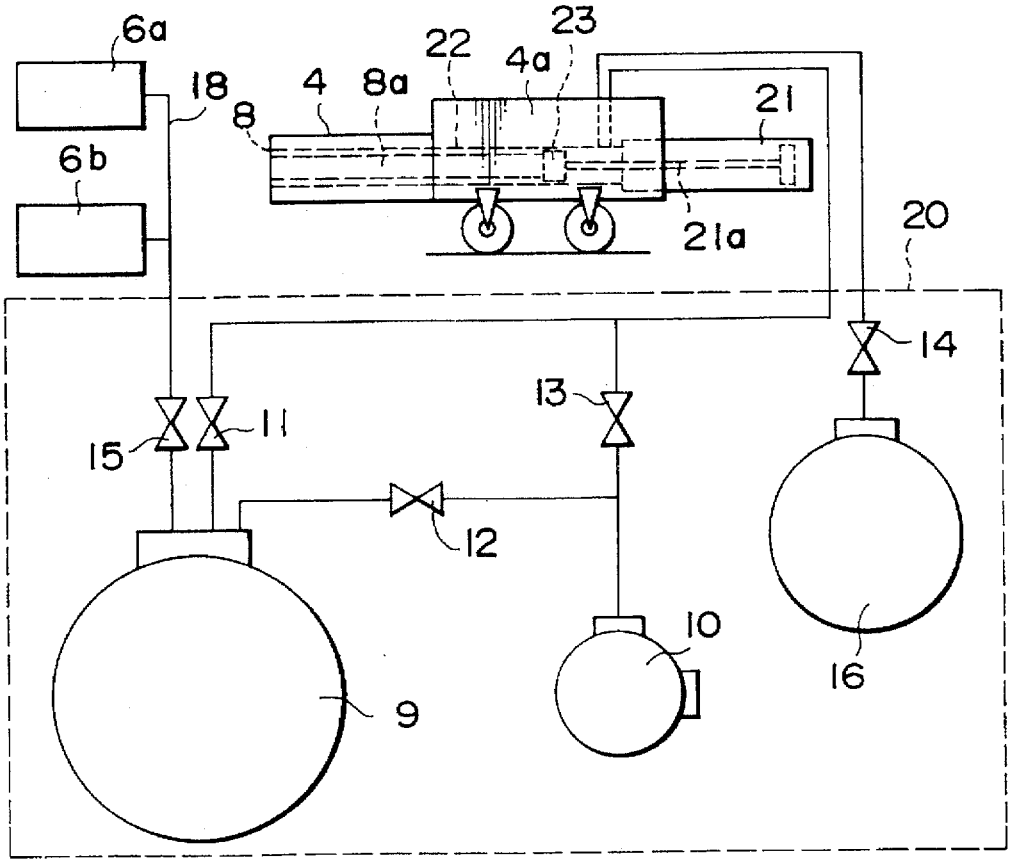
FIG. 2 is a piping system diagram of the quick pressure reducing apparatus of FIG. 1.
Figure 3:
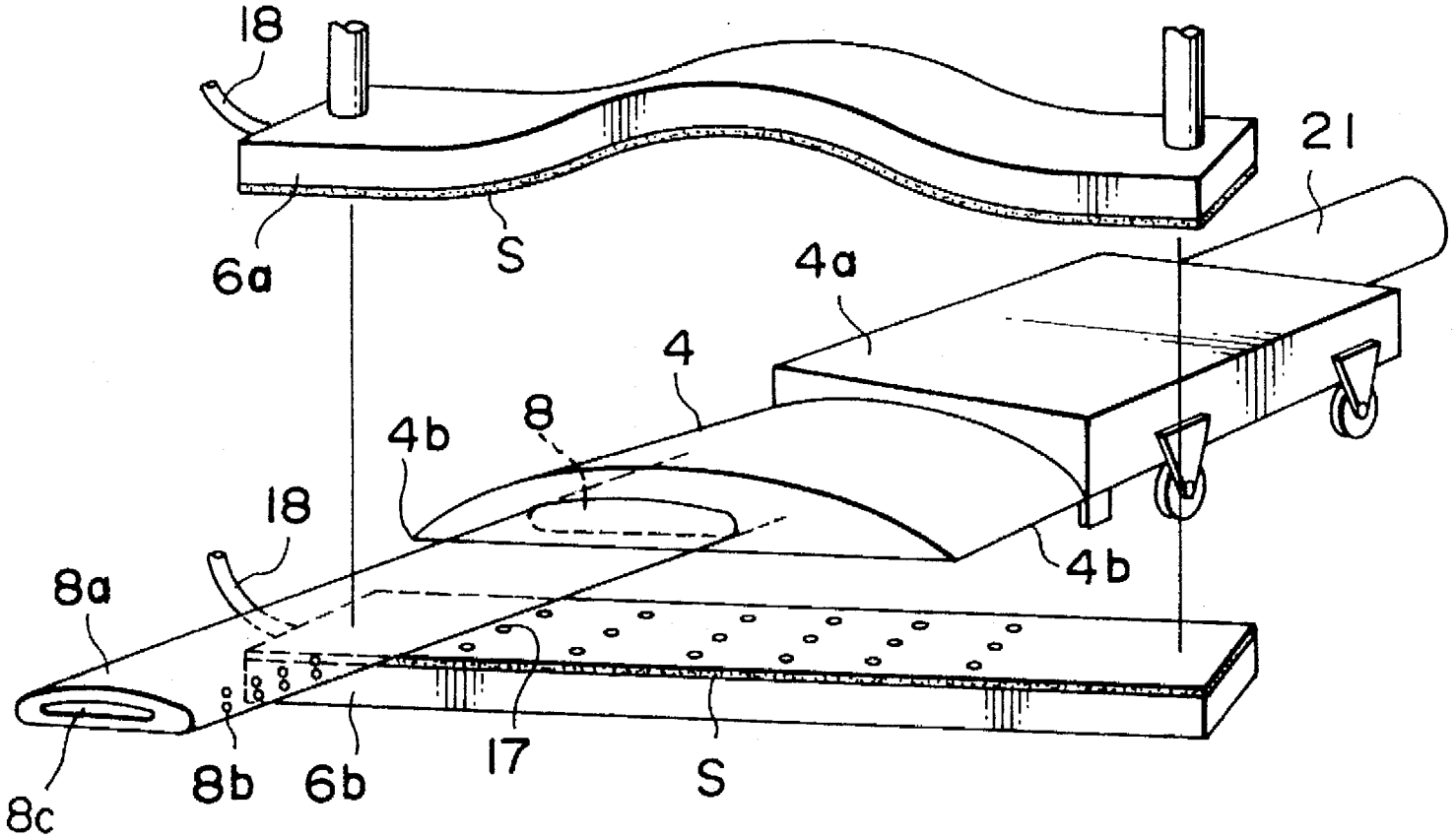
FIG. 3 is a perspective view of a main portion of the quick pressure reducing apparatus of FIG. 1.
Figure 4:
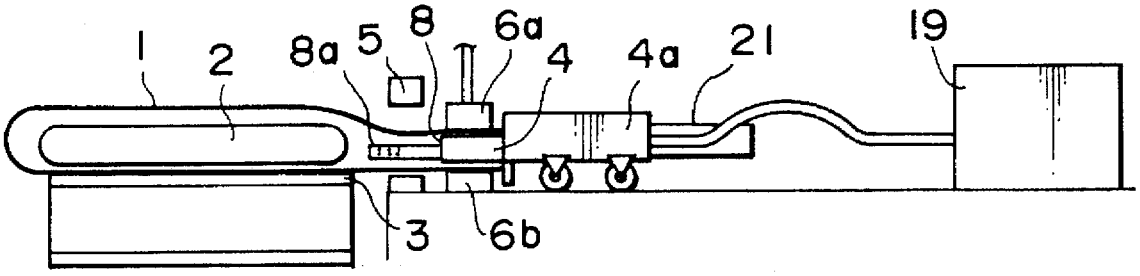
FIG. 4 is a diagram illustrating an operating step of the quick pressure reducing apparatus of FIG. 1.
Figure 5:
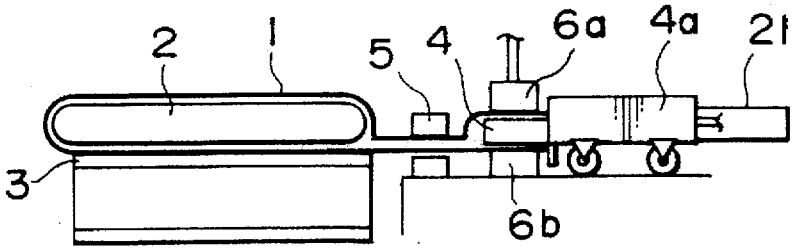
FIG. 5 is a diagram illustrating another operating step of the quick pressure reducing apparatus of FIG. 1.
Figure 6:
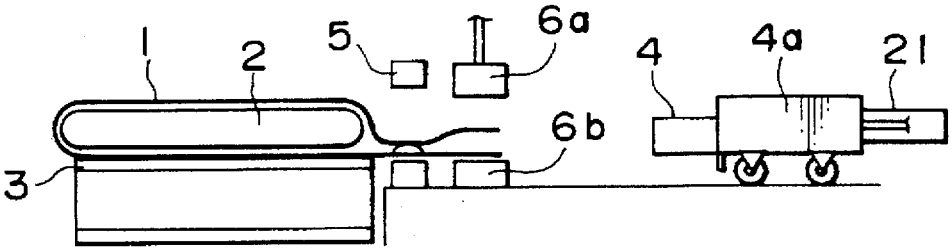
FIG. 6 is a diagram illustrating still another operating step of the quick pressure reducing apparatus of FIG. 1.

An embodiment of the present invention will now be described with reference to the drawings. FIG. 1 shows schematically a quick pressure reducing apparatus of the embodiment. FIG. 2 shows a piping system diagram of the apparatus. FIG. 3 shows details of a main portion of the apparatus. FIGS. 4 to 6 illustrate operating steps of the apparatus.

As shown in FIG. 1, a preservation bag 1 made of plastic film, which contains an article 2 to be preserved such as clothing or food, is conveyed on a conveyor 3 to a position where the preservation bag 1 faces an adapter 4 of the quick pressure reducing apparatus.

The adapter 4 is equipped with a traveling unit 4*a*, which is adapted to insert the adapter 4 into an opening portion 1*a* of the preservation bag 1 and to remove the adapter 4 from the same.

Between the conveyor 3 and the adapter 4 are provided a movable heat seal device 5 for sealing the opening portion 1*a* of the preservation bag 1, upper and lower holding members 6*a* and 6*b*, respectively, each having a seal pad S for holding the opening portion 1*a* together with the inserted adapter 4, and a hydraulic first drive mechanism 7 for adjusting the spacing between the holding members 6*a* and 6*b*. In order to secure the close holding by the holding members 6*a* and 6*b*, both edges 4*b* of the adapter 4 have a wedge shape (FIG. 3).

As shown in FIG. 3, a communicating bore 8 is formed in the adapter 4 so as to evacuate the preservation bag 1 or to lead an inert gas (nitrogen gas, carbon dioxide gas, etc.) into the same. A movable communicating tubular member 8*a* is inserted into the communicating bore 8 and projected and retracted by an air cylinder 21 serving as a second drive mechanism. As shown in FIG. 2, the rear end of the communicating tubular member 8*a* is connected to a movable element 23, which is slidably guided by a guide groove formed in a closed pipe 22 provided within the traveling unit 4*a*. A through hole 8*c* formed in the communicating tubular member 8*a* communicates with the interior of the closed pipe 22. The movable element 23 is connected to a piston rod 21*a* of an air cylinder 21.

The communicating tubular member 8*a*, which is thus driven by the air cylinder 21 via the piston rod 21*a* and the movable element 23, has a number of small holes 8*b* which are formed in the circumferential wall of the forward end thereof. The holes 8*b* communicate with the through hole 8*c* formed in the communicating tubular member 8*a*.

As shown in FIG. 2, the communicating tubular member 8*a* is connected to a reservoir tank 9 via the closed pipe 22 and a first valve 11. The reservoir tank 9 is connected to a rotary pump 10 via a second valve 12, and the rotary pump 10 can communicate with the communicating tubular member 8*a* via a third valve 13 and the closed pipe 22.

The communicating tubular member 8*a* of the adapter 4 is connected to an inert gas source (container) 16 via a closed pipe 22 and a fourth valve 14.

The third valve 13 and the fourth valve 14 may be integrated into a single changeover valve so as to quickly lead an inert gas from the inert gas source into the preservation bag 1 whose internal pressure has been reduced by the reservoir tank 9 and the rotary pump 10.

As shown in FIG. 3, each of the upper and lower holding members 6*a* and 6*b* has a number of suction holes 17 formed in its contact surface which contacts the circumferential wall of the opening portion of the preservation bag 1. The suction holes 17 communicate with the reservoir tank 9 via a flexible pipe 18 and a fifth valve 15, both shown in FIG. 2.

Those members enclosed by a dashed line 20 in FIG. 2 are contained in a casing 19 shown in FIG. 1.

The quick pressure reducing apparatus of the present embodiment having the above-described structure operates as follows. First, the first valve 11, the third valve 13, and the fifth valve 15 are closed while the second valve 12 is opened. Then, the rotary pump 10 is operated to establish a vacuum within the reservoir tank 9.

After the above-mentioned preparatory operation is performed, the preservation bag 1 is conveyed on the conveyor 3 to the position where the preservation bag 1 faces the adapter 4. Then, the upper holding member 6*a* is lowered, as shown in FIGS. 1 and 3, to hold the circumferential wall of the opening portion 1*a* of the preservation bag 1 between the upper and lower holding members 6*a* and 6*b*. The fifth valve 15 shown in FIG. 2 is opened to establish communication between the reservoir tank 9 and the suction holes 17. As a result, a negative pressure is established at the suction holes 17, so that the circumferential wall of the opening portion 1*a* of the preservation bag 1 is sucked by each of the holding members 6*a* and 6*b*. Thus, when the upper holding member 6a is raised, the opening portion 1a of the preservation bag 1 opens fully. Then, the traveling unit 4a is moved forward to insert the adapter 4 into the opening portion 1a of the preservation bag 1.

The holding member 6a is again lowered. Since the lateral edges 4b of the adapter 4 have a wedge shape, the holding members 6a and 6b hold tightly therebetween the opening portion 1a of the preservation bag 1 together with the inserted adapter 4 (FIG. 4).

While the holding members 6a and 6b hold tightly therebetween the adapter 4 together with the opening portion 1a as described above, the air cylinder 21 functioning as the second drive mechanism drives the communicating tubular member 8a so as to project the communicating tubular member 8a into the interior of the preservation bag 1. Then, the first valve 11 of FIG. 2 is opened to establish communication between the preservation bag 1 and the reservoir tank 9. As a result, the internal pressure of the preservation bag 1 is instantaneously reduced through the action of the reservoir tank 9. If it is needed to increase the degree of vacuum of the preservation bag 1, the first valve 11 and the second valve 12 are closed while the third valve 13 is opened, and then the rotary pump 10 is operated to further evacuate the interior of the preservation bag 1. This pressure reducing operation is smoothly performed, since a number of small holes 8b are formed in the circumferential wall of the forward end of the communicating tubular member 8a.

After the internal pressure of the preservation bag 1 is sufficiently reduced, the opening portion 1a of the preservation bag 1 may be immediately sealed using the heat seal device 5 as shown in FIG. 5. Alternatively, before performing this heat sealing, the fourth valve 14 shown in FIG. 2 may be opened to lead an inert gas such as nitrogen gas from the inert gas source 16 into the interior of the preservation bag 1. Adequate moisture may be given to the inert gas in accordance with the contents of the preservation bag 1. FIG. 6 illustrates a case where the preservation bag 1 is sealed while it is maintained under a vacuum.

Preferably, the volume of the reservoir tank 9 is sufficiently larger as compared with that of the preservation bag 1. For example, if the volume of the reservoir tank 9 is 20 times that of the preservation bag 1, the internal pressure of the preservation bag 1 will drop to about 0.05 atmosphere (strictly, 1/21 atmosphere) in 1 to 2 seconds after communication is established between the preservation bag 1 and the reservoir tank 9. Hence, it is not necessary to directly evacuate the interior of the preservation bag 1 using the rotary pump 10. Accordingly, in cooperation with the operation of directly reducing the internal pressure of the preservation bag 1 through the adapter 4, an article such as food, cleaned clothing, or the like can be quickly and easily sealed in the preservation bag 1.

Moreover, the quick pressure reducing apparatus of the present invention can be realized despite a very small capacity of the rotary pump 10 because the reservoir tank 9 can always be maintained at a large capacity in a vacuum condition by continuing operation of the rotary pump 10. Thus the rotary pump 10 can be operated under a relatively small load to facilitate maintenance thereof, and the manufacturing cost of the quick pressure reducing apparatus can be reduced due to the relatively small capacity of the rotary pump 10.

By contrast, in a conventional pressure reducing system not having the reservoir tank 9, the internal pressure of the preservation bag 1 is reduced only by the rotary pump 10, so that the pressure reducing work takes longer time, resulting in a lower work efficiency.

In the quick pressure reducing apparatus of the present embodiment, a number of small holes 8b are formed in the circumferential wall of the forward end of the communicating tubular member 8a, which is projected from the adapter 4 into the interior of the preservation bag 1. Accordingly, when the preservation bag 1 is rendered communicating with the reservoir tank 9 via the communicating tubular member 8a, the internal pressure of the preservation bag 1 is properly reduced without the opening edge portion of the preservation bag 1 or the preservation bag contents, such as clothing, being sucked onto the communicating tubular member 8a.

Since it takes the rotary pump 10 a certain time before it exhibits a sufficient evacuation rate after it is started, it is difficult for the conventional system to quickly evacuate the preservation bag 1. In contrast, in the quick pressure reducing apparatus of the present embodiment, the rotary pump 10 is always in operation, and in addition, even while the preservation bag 1 is conveyed and while the opening portion 1a of the preservation bag 1 is sealed by the heat seal device 5, the rotary pump 10 evacuates the reservoir tank 9. Accordingly, the pressure reduced packing work can be performed quite efficiently.

What is claimed is:

1. A quick pressure reducing apparatus comprising:

an adapter having a movable communicating tubular member adapted for insertion into an opening portion of a preservation bag, the movable communicating tubular member having a plurality of small holes formed in a circumferential wall of a front end portion thereof;

a pair of upper and lower holding members for holding the opening portion of the preservation bag after insertion of the movable communicating tubular member into the opening portion of the preservation bag, each of the upper and lower holding members having a seal pad;

a first drive mechanism for adjusting a spacing between the upper and lower holding members;

a second drive mechanism for projecting the front end portion of the movable communicating tubular member from inside of the adapter into the preservation bag;

a reservoir tank connected via a first valve to the movable communicating tubular member of the adapter for reducing the internal pressure of the preservation bag;

a rotary pump connected via a second valve to the reservoir tank; and a movable heat seal device capable of heating and thereby sealing the opening portion of the preservation bag.

2. A quick pressure reducing apparatus according to claim 1; wherein the rotary pump is connected to the movable communicating tubular member via a third valve.

3. A quick pressure reducing apparatus according to claim 2; further comprising an inert gas source connected to the movable communicating tubular member via a fourth valve so as to lead an inert gas into the preservation bag through the movable communicating tubular member after the internal pressure of the preservation bag has been reduced.

4. A quick pressure reducing apparatus according to claim 3; wherein the first and fourth valves are integrated into a single changeover valve.

5. A quick pressure reducing apparatus according to claim 4; wherein each of the upper and lower holding members has a contact surface for contacting a circumferential wall of the opening portion of the preservation bag, the contact surface of each of the upper and lower holding members having suction holes; and wherein the reservoir tank is connected to the suction holes of each of the upper and lower holding members via a fifth valve.

6. A quick pressure reducing apparatus according to claim 1; further comprising suction means for holding the opening portion of the preservation bag open by suction during insertion of the movable communicating tubular member into the preservation bag.

7. A quick pressure reducing apparatus according to claim 6; wherein each of the upper and lower holding members comprises a contact surface for contacting a circumferential wall of the opening portion of the preservation bag; and wherein the suction means comprises at least one suction hole provided on the contact surface of each of the upper and lower holding members.

8. A quick pressure reducing apparatus according to claim 7; wherein the reservoir tank is connected to the suction hole of each of the upper and lower holding members.

9. A quick pressure reducing apparatus comprising:

a tubular member having an end insertable into an opening portion of a preservation bag;

driving means for inserting the end of the tubular member into the preservation bag and withdrawing the end of the tubular member from the preservation bag;

vacuum applying means for applying a vacuum to the tubular member to reduce the internal pressure of the preservation bag when the end of the tubular member is inserted into the preservation bag, the vacuum applying means comprising a reservoir tank connected in fluid communication with the tubular member via a first valve, and a rotary pump connected in fluid communication with the reservoir tank via a second valve;

holding means for holding the opening portion of the preservation bag open during insertion of the end of the tubular member into the preservation bag and holding the opening portion of the preservation bag around the end of the tubular member during application of a vacuum by the vacuum applying means; and sealing means for sealing the open end of the preservation bag after the internal pressure of the preservation bag has been reduced to a preselected amount by the vacuum application means.

10. A quick pressure reducing apparatus according to claim 9; wherein the rotary pump is connected in fluid communication with the tubular member via a third valve.

11. A quick pressure reducing apparatus according to claim 10; further comprising means connected in fluid communication with the tubular member via a fourth valve for directing an inert gas into the preservation bag after the internal pressure of the preservation bag has been reduced.

12. A quick pressure reducing apparatus according to claim 11; wherein the first and fourth valves are integrated into a single changeover valve.

13. A quick pressure reducing apparatus according to claim 12; wherein the holding means comprises a pair of holding members each having a contact surface for contacting a circumferential wall of the opening portion of the preservation bag, the contact surface of each holding member having at least one suction opening for holding the opening portion of the preservation bag open by suction during insertion of the end of the tubular member into the preservation bag.

14. A quick pressure reducing apparatus according to claim 13; further comprising a seal pad disposed on the contact surface of each of the holding members for providing hermetic seal between the preservation bag and the tubular member during application of a vacuum by the vacuum applying means.

15. A quick pressure reducing apparatus according to claim 13; wherein the end of the tubular member has a circumferential wall provided with a plurality of openings in fluid communication with the reservoir tank and the rotary pump.

16. A quick pressure reducing apparatus according to claim 9; wherein the holding means comprises a pair of holding members each having a contact surface for contacting a circumferential wall of the opening portion of the preservation bag, the contact surface of each holding member having at least one suction opening for holding the opening portion of the preservation bag open by suction during insertion of the end of the tubular member into the preservation bag.

17. A quick pressure reducing apparatus according to claim 9; wherein the end of the tubular member has a circumferential wall provided with a plurality of openings in fluid communication with the vacuum application means.

18. A quick pressure reducing apparatus comprising:

a tubular member having an end insertable into an opening portion of a preservation bag;

driving means for inserting the end of the tubular member into the preservation bag and withdrawing the end of the tubular member from the preservation bag;

vacuum applying means for applying a vacuum to the tubular member to reduce the internal pressure of the preservation bag when the end of the tubular member is inserted into the preservation bag, the vacuum applying means comprising a reservoir tank connected in fluid communication with the tubular member via a first valve, and a rotary pump connected in fluid communication with the reservoir tank via a second valve;

holding means including at least one suction opening in fluid communication with the vacuum applying means for holding the opening portion of the preservation bag open by suction during insertion of the end of the tubular member into the preservation bag; and means for providing a hermetic seal between the preservation bag and the tubular member during application of a vacuum by the vacuum applying means.

19. A quick pressure reducing apparatus according to claim 18; further comprising heat sealing means for heating and sealing the open end of the preservation bag after the internal pressure of the preservation bag has been reduced to a preselected amount by the vacuum applying means.

20. A quick pressure reducing apparatus according to claim 18; wherein the end of the tubular member has a circumferential wall provided with a plurality of openings in fluid communication with the vacuum application means.

21. A quick pressure reducing apparatus according to claim 19, wherein the rotary pump is connected in fluid communication with the tubular member via a third valve.

22. A quick pressure reducing apparatus according to claim 21; further comprising means connected in fluid communication with the tubular member via a fourth valve for directing an inert gas into the preservation bag after the internal pressure of the preservation bag has been reduced.

23. A quick pressure reducing apparatus according to claim 22; wherein the first and fourth valves are integrated into a single changeover valve.

* * * * *